US005904644A

United States Patent [19]

Dronsfield

[11] Patent Number: 5,904,644

[45] Date of Patent: May 18, 1999

[54] ENVELOPE CLOSER

[75] Inventor: David Mark Dronsfield, Essex, United Kingdom

[73] Assignee: Printed Forms Equipment Limited, Essex, United Kingdom

[21] Appl. No.: 08/894,445

[22] PCT Filed: Feb. 6, 1996

[86] PCT No.: PCT/GB96/00260

§ 371 Date: Aug. 19, 1997

§ 102(e) Date: Aug. 19, 1997

[87] PCT Pub. No.: WO96/26075

PCT Pub. Date: Aug. 29, 1996

[30] Foreign Application Priority Data

Feb. 21, 1995 [GB] United Kingdom ..... 9503427

[51] Int. Cl.[6] ..... B31F 1/00; B43M 5/04

[52] U.S. Cl. ..... 493/245; 493/249; 493/420; 53/284.3; 53/377.6

[58] Field of Search ..... 493/245, 453, 493/435, 419; 53/284.3, 377.6, 376.3, 378.3

[56] References Cited

U.S. PATENT DOCUMENTS

| | | | |
|---|---|---|---|
| 3,097,578 | 7/1963 | Winkler et al. | 493/419 |
| 3,242,637 | 3/1966 | Wills | 53/284.3 |
| 4,619,101 | 10/1986 | Havey, Jr. et al. | 53/284.3 |
| 4,955,186 | 9/1990 | Gough | 53/284.3 |
| 5,125,885 | 6/1992 | Wooley et al. | 493/245 |
| 5,129,876 | 7/1992 | Brabant et al. | 493/419 |
| 5,511,357 | 4/1996 | Ricketts et al. | 53/284.3 |

*Primary Examiner*—James F. Coan
*Assistant Examiner*—Steven Jensen
*Attorney, Agent, or Firm*—Young & Thompson

[57] ABSTRACT

Apparatus and method for closing an envelope having a body portion and a flap, and a crease between the body portion and the flap. An open envelope is gripped and transported toward an abutment, which can be either a leaf spring or a slideable weight. The abutment is biased toward the envelope, but the force of the advancing envelope moves the abutment in a direction opposite the direction of bias, until the crease clears the transport structure that is moving the envelope. Once this happens, then the advance of the envelope stops and the bias of the abutment forces the envelope, crease first, between rollers that press the folded flap against the envelope. Any size envelope can be handled, because the abutment can move under the force of the envelope, any distance required to accommodate the size of the envelope.

9 Claims, 2 Drawing Sheets

ENVELOPE CLOSER

FIELD OF THE INVENTION

This invention relates to apparatus for closing an envelope.

BACKGROUND OF THE INVENTION

In automatic mailing machines there is a need for a reliable apparatus for closing envelope flaps after the envelopes have been filled. A difficulty in this respect is that the apparatus may be required to close envelopes of different sizes, wherein the distance from the flap to the opposite edge of the envelope varies.

SUMMARY OF THE INVENTION

Accordingly, the present invention provides an apparatus for closing an envelope comprising first transport means for gripping an envelope and transporting it towards an abutment member, in which the abutment member is biased towards the first transport means and is arranged to be movable away from the first transport means against the bias by means of abutment with an envelope being transported by first transport means, unless the crease of the envelope flap lies between the transport means and the abutment means, and second transport means for transporting a folded envelope away from the abutment means, the second transport means being arranged to apply pressure to the folded flap of the envelope.

Thus the apparatus can accomodate envelopes of different sizes without the need for adjustment.

The invention also provides a method of closing an envelope comprising: feeding the envelope towards an abutment member in a direction with the edge of the envelope opposite to the flap first; the abutment member being biased towards the envelope such that it is movable against the bias by the envelope unless the crease of the envelope flap lies between the feeding means and the abutment means, such that the envelope folds at the crease; feeding the folded envelope away from the abutment means; and applying pressure to the folded envelope.

In a preferred embodiment, the first and second transport means each comprise a pair of rollers. For example, the first transport means comprises first and second rollers, and the second transport means comprises the second and a third roller. In this case, the second roller may have a textured surface, for providing frictional adherence with the folded crease of the envelope.

The abutment means is conveniently mounted in a channel for receiving the envelope. For example, the abutment means may comprise the free end of a leaf spring projecting into the channel. The abutment means may be mounted above the first transport means, in which case the abutment means may comprise a slidably mounted weight.

BRIEF DESCRIPTION OF THE DRAWINGS

In order that the invention may be more readily understood, reference will now be made, by way of example, to the accompanying schematic drawings, in which.

DETAILED DESCRIPTION OF THE INVENTION

Figure 1:
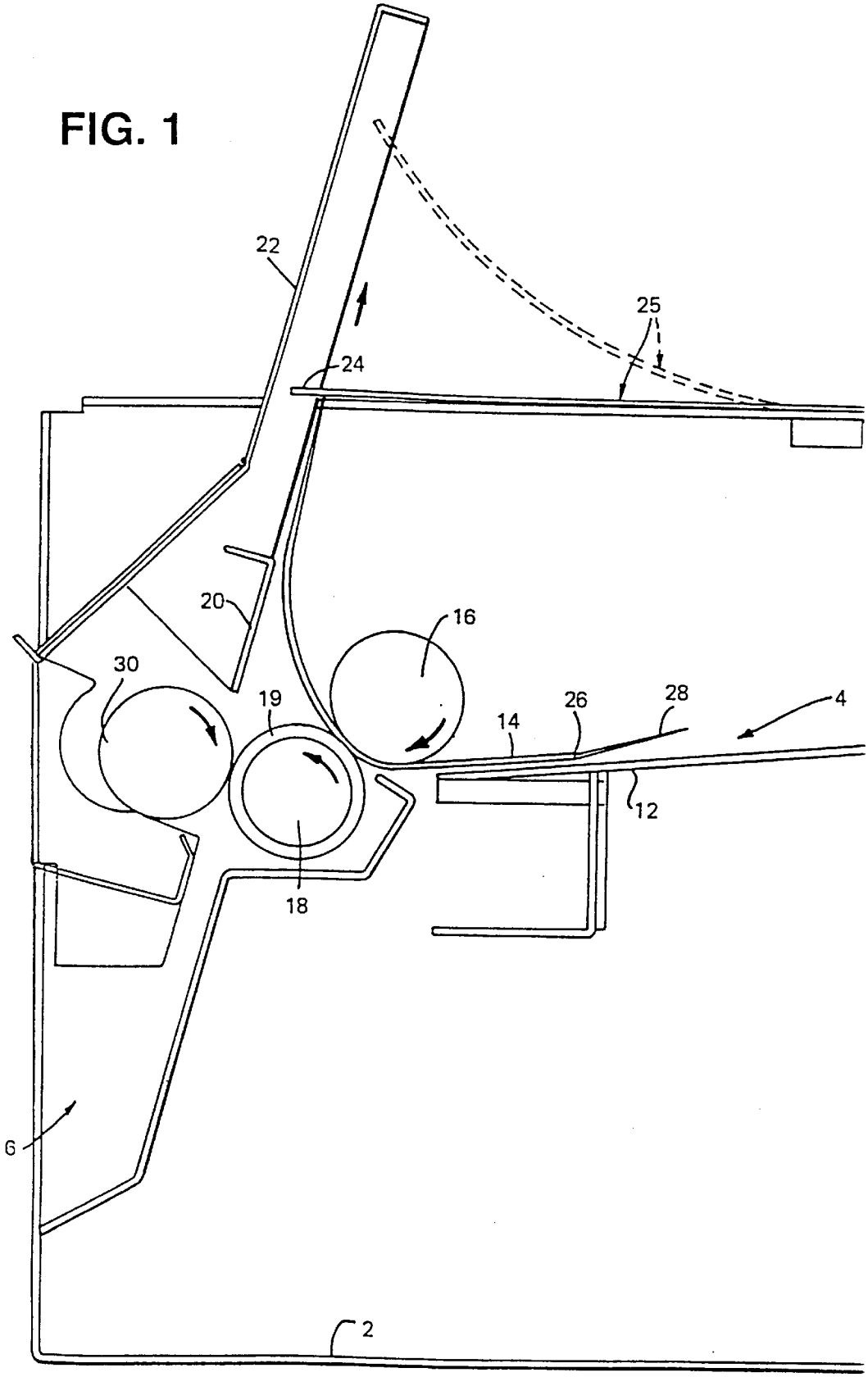
FIG. 1 is cross-sectional side view of an apparatus according to one embodiment of the invention.

Referring to FIG. 1, the apparatus has a housing 2 including an entrance region 4 for open envelopes, and an exit region 6 for closed envelopes. The entrance region 4 includes a support surface 12 for supporting envelopes for introduction into the apparatus, for example by means of a pair of feed rollers. Such a pair of feed rollers may for example be one of a plurality of such pairs mounted adjacent the support surface 12, for example for transporting envelopes from a filling station where the contents are inserted.

First transport means comprises first and second nip rollers 16, 18, for transporting an envelope 14 towards an abutment member 24 in the form of the free end of a leaf spring 25. The leaf spring 25 is conveniently mounted on the housing 2 above the first and second nip rollers 16, 18, such that the distance between the first and second nip rollers 16, 18 and the free end 24 of the spring 25 is smaller than the depth of the smallest envelope with which the apparatus is intended to be used, where the depth is the distance from the crease of the envelope flap to the opposite edge of the envelope. A channel 22, including a baffle 20 is provided to guide the envelope 14, from the first and second rollers 16, 18 to the end of the leaf spring 25. The leaf spring 25 is arranged to provide a biasing force towards the first and second rollers 16, 18 which can be overcome by an envelope 14 before transported thereby, such that the end 24 of the leaf spring 25 is movable against the bias. However the biasing force is such that, if an envelope crease 26 lies between the first and second rollers 16, 18 and the end of the leaf spring 25, the envelope is no longer sufficiently rigid to overcome the bias, and the envelope 14 folds at the crease 26 as the flap 28 is fed out of the first and second nip rollers 16, 18.

A third nip roller 30 is provided to cooperate with the second nip roller 18 to form second transport means for transporting the folded envelope out of the apparatus through the exit region 6. When the end of the flap 28 has left the first and second nip rollers 16, 18, the envelope no longer provides a force against the bias of the leaf spring 25, which therefore urges the envelope downwardly towards the second and third nip rollers 18, 30, again guided by the baffle 20. It can be seen that transporting envelopes into and out of the apparatus can be effected by rotating the second roller continuously in the same direction. The second nip roller 18 may have a rubberized outer surface 19 to encourage frictional adherence with the envelope crease 26, to carry it from the nip with the first roller 16 to the nip with the third roller 30. The nip of the second and third nip rollers 18, 30 also serves to apply pressure to the folded flap of the envelope, for example to seal the envelope.

FIGS. 2*a* to 2*d* illustrate the process of closing the envelope, according to a modified version of the apparatus according to the invention. In this embodiment, the abutment member 32 is a weight slidably mounted in a channel 34. The weight 32 rests at a distance from the nip 37 between first and second rollers 36, 38 which is smaller than the depth of the smallest envelope with which the apparatus is to be used.

Figures 2A, 2B, 2C, 2D:
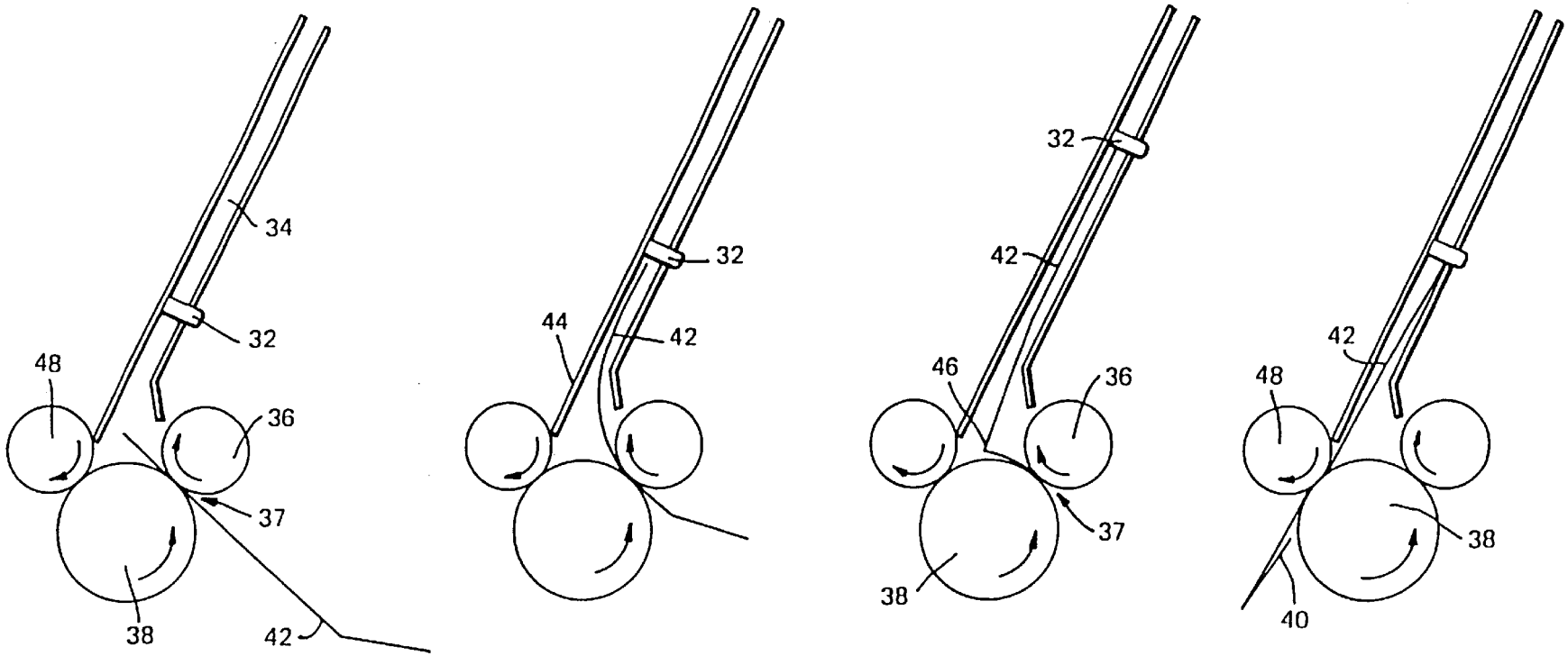
FIGS. 2*a* to 2*d* are cross-sectional side views of an apparatus according to another embodiment of the invention.

In FIG. 2*a*, the first and second rollers 36, 38, which constitute first transport means, drive an envelope 42 into the apparatus. In FIG. 2*b* the envelope 42 is deflected by the far wall 44 of the channel to abut the weight 32, and slide it up the channel. In FIG. 2*c*, the envelope crease 47 has left the nip 37 of the first and second rollers 37, 38 and the envelope folds at the crease 47 under the downward force of the weight 32. The folded crease of the envelope 42 is then guided by the second roller 38 into a second nip between the second and third rollers 48. The envelope is transported out of the apparatus thereby, and also pressed to seal the flap 40, as the weight 32 returns to its rest position.

I claim:

1. Apparatus for closing an envelope having a body portion and a flap, and a crease between the body portion and the flap, the apparatus comprising first transport means for gripping an open envelope and transporting it towards an abutment, and second transport means for transporting the folded envelope away from the abutment, in which the abutment is biased towards the first and second transport means, the abutment being arranged to be movable away from the first transport means against the bias by means of abutment with an envelope being transported by the first transport means when the body portion of the envelope lies between the first transport means and the abutment, and being arranged to be movable with the bias towards the second transport means when the crease between the body portion and the flap also lies between the first transport means and the abutment such that the envelope folds at the crease, the second transport means being arranged to apply pressure to the folded flap of the envelope.

2. Apparatus as claimed in claim 1, in which the first and second transport means each comprise a pair of rollers.

3. Apparatus as claimed in claim 2, in which the first transport means comprises first and second rollers, and the second transport means comprises the second and a third roller.

4. Apparatus as claimed in claim 3, in which the second roller has a textured surface, for providing frictional adherence with the folded crease of the envelope.

5. Apparatus as claimed in claim 1, in which the abutment is mounted in a channel for receiving the envelope.

6. Apparatus as claimed in claim 1, in which the abutment comprises the free end of a leaf spring.

7. Apparatus as claimed in claim 1, in which the abutment is mounted above the first transport means.

8. Apparatus as claimed in claim 7, in which the abutment is a slidably mounted weight.

9. A method of closing an envelope having a body portion and a flap, and a crease between the body portion and the flap, the method comprising: feeding the envelope towards an abutment in a direction with the edge of the envelope opposite to the flap first; biasing the abutment toward the envelope; moving the abutment in said direction against said bias by pressure of the envelope on the abutment until the crease of the envelope lies between the feeding means and the abutment, such that the envelope folds at the crease, feeding the folded envelope away from the abutment; and applying pressure to the folded envelope.

* * * * *